United States Patent [19]

Colburn et al.

[11] 4,095,937

[45] Jun. 20, 1978

[54] INSULATION FOR WATER COOLED PIPES IN A REHEATING FURNACE

[75] Inventors: Steven C. Colburn, La Palma; Marion H. Black, Anaheim, both of Calif.

[73] Assignee: Hitco, Irvine, Calif.

[21] Appl. No.: 740,062

[22] Filed: Nov. 8, 1976

[51] Int. Cl.[2] ..... F27D 9/00; F27D 3/02

[52] U.S. Cl. ..... 432/3; 138/144; 138/149; 138/150; 432/233; 432/234

[58] Field of Search ..... 432/3, 233, 234; 138/144, 147, 149, 150

[56] References Cited

U.S. PATENT DOCUMENTS

| | | | |
|---|---|---|---|
| 2,857,931 | 10/1958 | Lawton | 138/149 |
| 3,725,117 | 4/1973 | Caruso | 428/265 |
| 3,820,947 | 6/1974 | Boto et al. | 138/149 |
| 3,979,818 | 9/1976 | Groch et al. | 138/149 |

*Primary Examiner*—John J. Camby
*Attorney, Agent, or Firm*—Fraser and Bogucki

[57] ABSTRACT

In a metal reheating furnace, a resilient, vibration resistant and easily installed thermal insulative structure is defined by an inner batt of refractory fibers held in place by an outer wrapping of woven refractory fibers and so arranged as to be self-retaining. This relatively soft, resilient structure supports an outer shell of refractory mortar which adheres to but does not substantially penetrate the woven wrapping, such that vibration and mechanical shock are absorbed in the soft insulation while the exterior layer protects against molten slag and high speed impinging gas flows.

9 Claims, 5 Drawing Figures

24
16
14
13
12
10
11
20
21
22
23
17
18
3
X

INSULATION FOR WATER COOLED PIPES IN A REHEATING FURNACE

BACKGROUND OF THE INVENTION

This invention relates to insulation for water cooled pipes, and more specifically to insulation for reducing thermal energy losses in water cooled piping systems of a steel reheating furnace.

In steel mills, blooms, slabs, billets and bars must usually be reheated for a subsequent rolling or refinishing operation. The reheating is effected in a large refractory furnace along which the bodies to be reheated are advanced from an inlet end to an exit end along skid pipes across which they are transversely disposed. Because the temperature of the furnace must be on the order of 2400° F. and the steel must be reheated uniformly throughout, the furnace must be of substantial length and high mechanical loads are placed on the supporting structure. To withstand these loads, a quite massive water cooled support system and large hollow pipes are used to provide the structural base for the skids. In order to prevent excessive loss of thermal energy within the furnace, horizontal and vertical parts of the piping are shielded by insulation.

In the prior art, rigid refractory insulation has extensively been used, but as noted in the patent to Boto et al., U.S. Pat. No. 3,820,947, the mechanical stresses and shocks within the skid system are transmitted to these preformed parts and cause unwanted fractures and destructive effects. It should also be noted that materials and labor costs for such installations are extremely high. In consequence, Boto el al propose the special construction in which an insulating blanket is disposed about the pipes, and held in place by a combination of threaded alloy studs projecting from the pipes, a refractory anchor held on the studs by a lock nut which is covered by a layer of high temperature mortar, and a rigidizing surface spray which penetrates substantially into the interior of the blanket. A number of other combinations of insulative blankets and rigid structures have been suggested, as evidenced by the patents to Greaney, U.S. Pat. No. 3,329,414 and Doherty et al., U.S. Pat. No. 3,486,533, but all suffer from substantial disadvantages in terms of the excessive amount of time required to install the structures, and the expense and difficulty of specially modifying the supporting structure.

In addition to the mechanical vibration and shock problems encountered in the furnace, insulative structures must be capable of withstanding falling and flying molten slag, which is continually being generated during furnace operation. In addition, the heat fluxes required are so high that substantial forces are generated by the impinging high velocity gases from the furnace jets. Accordingly, workers in the art have inherently considered that expensive high strength structures are required to meet these demanding conditions.

SUMMARY OF THE INVENTION

An insulative structure for the water cooled pipes in a reheating furnace is defined by a composite volumetric system including a relatively thick layer of insulative blanket in contact with the water cooled pipe, an overlying wrapping of self-retaining fabric material, and a relatively thin exterior layer of refractory mortar. In a particular example of a structure in accordance with the invention, the insulating blanket comprises an alumina-silica batt material of approximately 1 inch thickness, and the overlying wrapping comprises a double layer of leached silica fiber tape in which the fibers have a chromic oxide coating, the wrapping being helically wound about the insulating blanket. The exterior refractory mortar layer comprises an approximately ¼ inch thickness, such that mechanical shocks transmitted within the system from the piping are absorbed within the blanket and wrapping structure and the relatively light weight mortar shell provides protection against molten slag and impinging gas jets without itself being fractured under normal use. In methods in accordance with the invention, sections of batt may be installed in conformity with a particular pipe section, whether straight, bent or a crossover, and temporarily retained in place by a thin adhesive layer facing the pipe, or by a partial tape wrap. The woven refractory fiber, preferably in a tape form, is then wrapped about the exterior of the blankets, following which the mortar may be painted or troweled on to the desired thickness.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
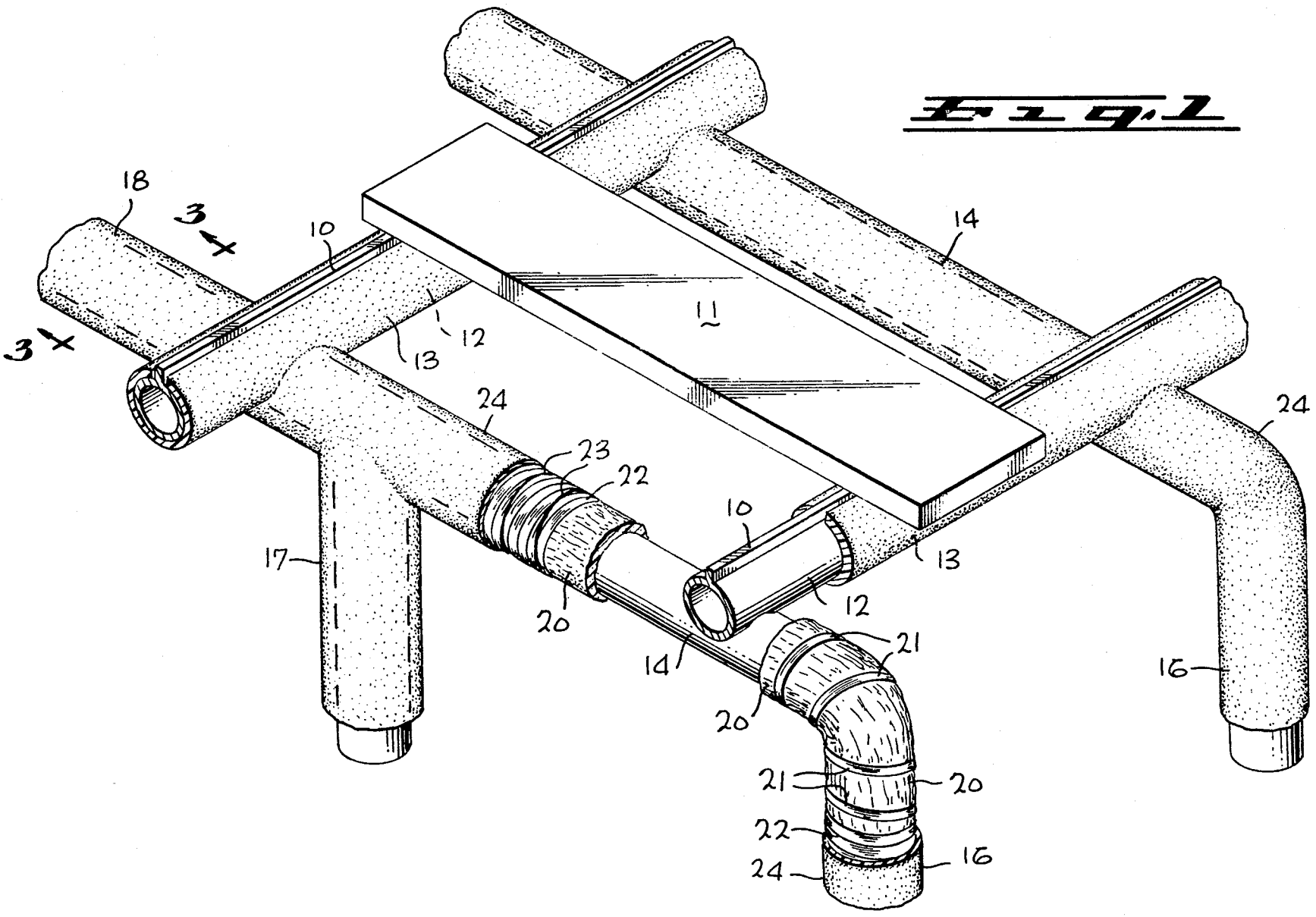
FIG. 1 is somewhat simplified perspective view of a portion of a water cooled piping system for a reheating furnace, incorporating insulation in accordance with the invention.

In a conventional reheating furnace, referring now to FIG. 1, skids 10 which may be horizontal or inclined depending upon the particular furnace design support transversely disposed slabs, blooms, billets or bars 11 for movement within the furnace. The skids 10 project upwardly from water cooled skid supports 12 comprising hollow, cylindrical pipes which are here assumed to be insulated with conventional solid refractory material 13 (not shown in detail). The skid supports 12 are in turn supported by transverse members 14 comprised of hollow, cylindrical pipes which at each end follow a 90° or hairpin bend into a vertical riser portion 16 thereof and which cross over and are attached to vertical riser portions 17 along the lengths thereof. Both the hairpin bends and the crossover points between the transverse members 14 and the vertical riser portions 16 and 17 are difficult to insulate economically in accordance with prior art techniques.

Figure 2:
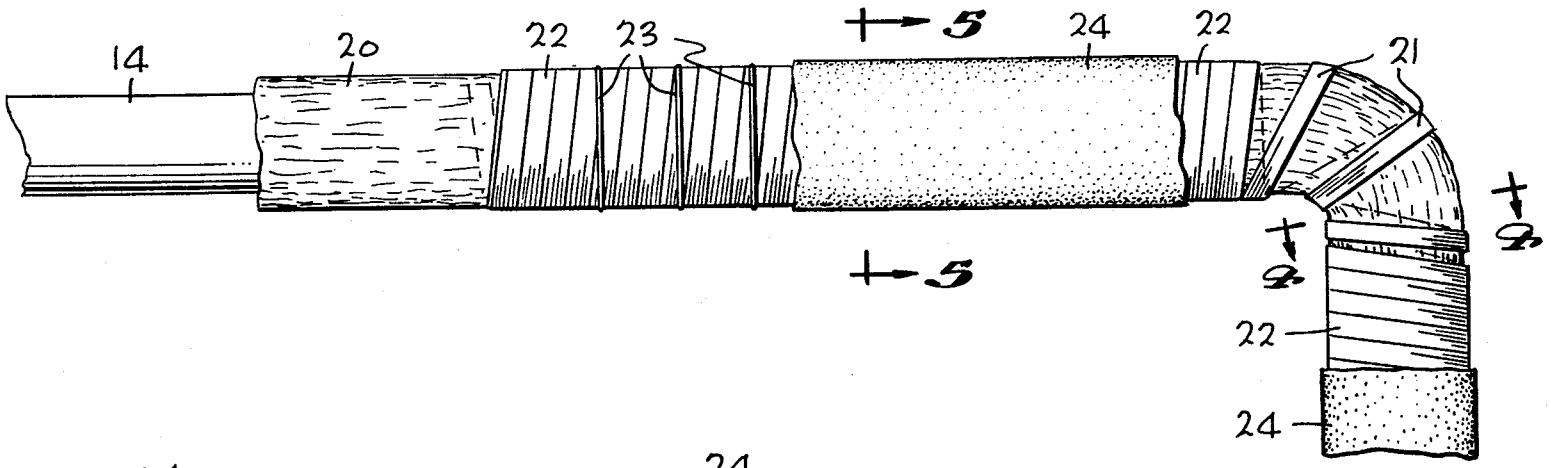
FIG. 2 is a side view of a portion of the piping system of FIG. 1 showing the progressive steps of insulating the piping system in accordance with the invention.
Figure 3:
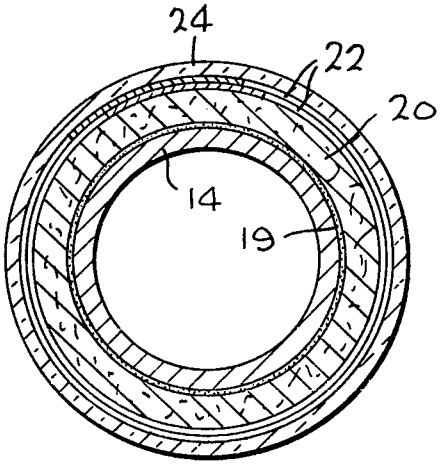
FIG. 3 is a cross-sectional view of a portion of the piping system shown in FIG. 1 taken along the line 3—3 thereof.

Referring to FIGS. 2–5 in addition to FIG. 1, and in accordance with the invention, an approximately 1 inch thick batt of refractory fibers such as alumina-silica fibers is disposed directly in contact with the exterior of both the transverse members 14 and the vertical riser portions 16 and 17. For work on relatively short spans of pipe as at the portion 18 of the transverse member 14, a given width of batt 20 (typically 2 ft.) is cut to a length to match the circumference of the pipe. A low cost temporary adhesive such as rubber cement or other organic adhesives may be applied to the pipe or to the inner surface of the batt, forming an adhesive layer 19 as seen in FIG. 3, to enable the batt 20 to be held in place until outer layers are formed thereon. A suitable batt is sold under the trademark "KAOWOOL" by Babcock & Wilcox Company, although a variety of other fibrous refractory materials having temperature resistance up to approximately 2500° F. are available. Inasmuch as the batt is in contact with and cooled by the water cooled pipe, a lower temperature characteristic, which is obtainable at substantially lower cost, can be tolerated.

Figure 5:
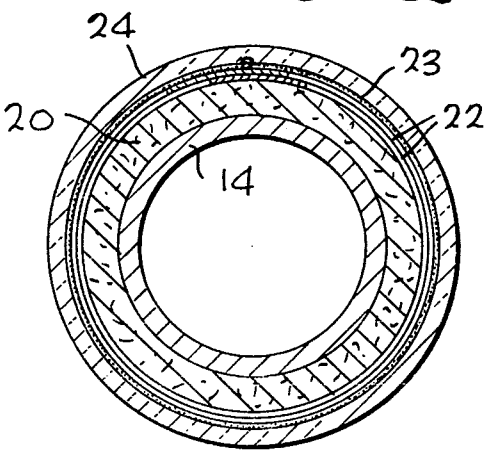
FIG. 5 is a cross-sectional view of the portion of the piping system shown in FIG. 2 taken along the line 5—5 thereof.
Figure 4:
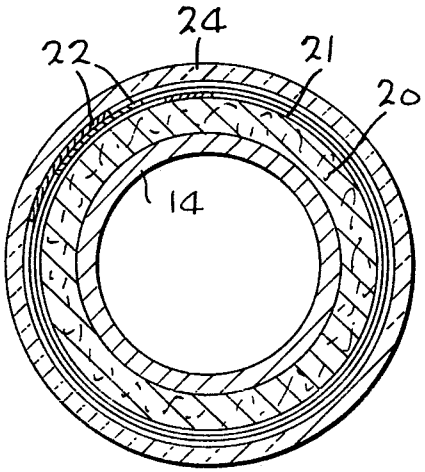
FIG. 4 is a cross-sectional view of the portion of the piping system shown in FIG. 2 taken along the line 4—4 thereof.

In the practice of the invention, the experience has been that operators quickly learn to gauge the shapes needed to cover the non-uniform sections such as the hairpins and the crossover. A single operator can conveniently complete all the steps sequentially, either by using adhesive to temporarily affix the batt 20 to the pipes such as the portion 18 or other relatively straight portions of the pipe, or by wrapping the batts with a loose helical wrap 21 of high temperature tape such as at a hairpin 22, shown in cross-section in FIG. 4, or other curved portions of the pipe where it is more difficult to hold the batt 20 in place. When a section of batt 20 is in place about the pipes, it is then covered and permanently held in place by a superior wrapping of higher temperature refractory material having generally continuous fibers in tape or similar form. One example of such wrapping is a 3 inches wide woven fabric tape of "IRISH REFRASIL" sold by HITCO of Gardena, Ca. "IRISH REFRASIL" is a trademark designation for a leached silica fibrous product having a chromium oxide fiber coating, and made, for example, in accordance with the teachings of Caruso U.S. Pat. No. 3,725,117. Other fibrous refractory materials such as aluminum oxide can also be used, and are preferably formed into a tape of continuous fibers. In accordance with the invention, the tape 22 may be completely self-retained by affixing one end by wrapping several turns tightly, and then helically wrapping the tape 22 about the batt 20 to provide two layers until an end point is reached, at which the tape 22 is simply tucked in on itself and tightened. Two layers are adequate in most instances and provide a combined thickness of about 0.050 inch when 3 inches wide woven fabric tape is used. For greater adhesion, a tape 22 having a pressure sensitive layer on one side has been employed, but the exterior wrapping proceeds sufficiently rapidly that considerable skill may be required to prevent the tape from adhering to itself or becoming entangled during installation. Alternatively, to insure securement of the tape 22, and to prevent unwinding of the helical wrap in the event of an unexpected mechanical tear or some other cause, spaced-apart ties 23 of "IRISH REFRASIL" may be wrapped quickly and readily about the layers as seen in FIGS. 1, 2 and 5. The ties 23 may be used throughout the water cooled piping or at selected locations as desired, and are particularly advantageous when used in the regions of the skid supports 12 and similar areas where the insulation is subjected to intense heat and falling slag.

The constructions described thus far are satisfactory for a wide range of applications, or portions of installations. In areas of a furnace where molten slag flow and gas jet velocity are low, the insulating structure remains in place unaffected by the high temperature environment, mechanical shocks and other forces, without significant deleterious effects. Minor embrittlement of the fibrous structure may occur with time, but without any deleterious effects on the insulative properties or the mechanical integrity. The costs of materials and installation costs are such that the installed price is of the range of one-third to one-quarter of installations made using present technology. The insulative effect is at the same time fully comparable to the known structures, and satisfactory for all operating purposes. However, in the average installation it is desired to insure, at least in part, against damaging effects that may be encountered with molten slag and high velocity gas flows. Molten slag is extremely fluid, and tends to flow around the insulative layers upon which it falls, thus while quickly eroding the fibers. The helically wrapped layers of tape 22 can become separated or slightly wedged apart by impinging gas flows, leading to gradual penetration into the interior of the insulation or even unwrapping of the tape. Thus in its preferred form the invention includes an outer layer 24 of a suitable retractory mix such as mortar which can be applied in a softened state and which thereafter air sets to form a hard outer insulating shell. The mortar which is of approximately ¼ inch thickness, is painted or troweled onto the entire outer surface of the tape 22 in a wet condition, and permitted to become dry and then fired as the furnace reaches temperature. The refractory mortar 24 does not penetrate into the tape 22 but adequately adheres thereto. Thus the insulative value of the tape 22 and the batt 20 are retained, but at the same time a barrier to fluids is provided. Although the mortar layer 24 would not be able to withstand substantial mechanical shock, whether impact or vibration, by itself, it is found to have a long life while providing the desired protection because coaction with the underlying batt 20 and tape 22 enables the mortar layer 24 to maintain its physical integrity during operation. Structures in accordance with the invention have been installed in reheating furnaces for in excess of six months of use, including periods of cycling between normal operating regimes and down time conditions, and have far surpassed other types of insulation.

Methods in accordance with the invention embody the steps previously described in some detail in a general sequence starting with preparation of the inner layer of batt material 20. Because the batt material is light weight and readily handled, it can be deformed to a limited extent so as to conform to the configuration of a section of pipe. In some instances the batt 20 will remain in place by itself pending application of the tape wrap 22, while in other instances the batt is preferably held in place by means such as the adhesive 19 or the helical wrap 21. The relatively thin outer wrapping of tape 22 which is next applied provides the preferred means for securing the structure in place, but a section of fabric having a composition like that of the tape may alternatively be employed, particularly where a long continuous span of pipe is to be covered. Where the ties 23 are to be used, they are installed in spaced-apart relation along the length of the piping on the outside of the tape 22. The ties are tied together using knots or other appropriate fastening means. Where the layer of mortar 24 is to be formed, it is next applied by brushing until the desired thickness is built up or by troweling on to a desired thickness.

While the invention has been particularly shown and described with reference to preferred embodiments thereof, it will be understood by those skilled in the art that the foregoing and other changes in form and details may be made therein without departing from the spirit and scope of the invention.

What is claimed is:

1. Vibration resistant insulation for water cooled members of a skid rail system in a reheating furnace comprising:

a plurality of permeable resilient fibrous alumina-silica mat sections wrapped around the water cooled members in abutting relationship and approximately one inch in thickness;

a plurality of outer silica fiber sections about said mat sections for holding said mat sections in place around said members, the outer sections comprising chromium-oxide surfaced silica tape;

the mat sections and outer sections being resilient, self-supporting and conforming to the configuration of the members; and a layer of non-penetrating refractory mortar outside of and adhering to the silica tape.

2. The invention as set forth in claim 1, wherein the outer sections are approximately 0.050 inch thick and the mortar is approximately ¼ inch thick.

3. Vibration resistant insulation for use with a member to be insulated comprising an inner layer of material of substantially fibrous refractory composition disposed on the outside of and surrounding the member to be insulated, a plurality of outer layers of material of substantially fibrous refractory composition in the form of a tape of continuous fibers disposed on the outside of and generally coextensive with the inner layer, the inner layer and the plurality of outer layers being generally resilient and self-supporting, and a layer of hardened refractory mortar disposed on the outside of and generally coextensive with the plurality of outer layers.

4. Vibration resistant insulation for use with a member to be insulated comprising an inner layer of material of substantially fibrous refractory composition disposed on the outside of and surrounding the member to be insulated, a plurality of outer layers of material of substantially fibrous refractory composition in the form of a tape of continuous fibers disposed on the outside of and generally coextensive with the inner layer, and the plurality of outer layers being generally resilient and self-supporting, and a wrap disposed between the inner layer and the plurality of outer layers, the wrap being wound around the outside of the inner layer in spaced-apart loops and being comprised of heat resistant material.

5. The invention as set forth in claim 4, wherein the member to be insulated and the inner layer and the plurality of outer layers are of generally cylindrical configuration and the wrap comprises a tape of generally silica fiber composition helically wrapped around the inner layer.

6. Vibration resistant insulation for use with a member to be insulated comprising an inner layer of material of substantially fibrous refractory composition disposed on the outside of and surrounding the member to be insulated, a plurality of outer layers of material of substantially fibrous refractory composition in the form of a tape of continuous fibers disposed on the outside of and generally coextensive with the inner layer, the inner layer and the plurality of outer layers being generally resilient and self-supporting, and a plurality of spaced-apart loops of heat resistant material on the outside of and surrounding the outer layers to hold the outer layers in place on the inner layer.

7. A method of insulating a water cooled member of a skid rail system in a reheating furnace comprising the steps of:

wrapping a permeable resilient mat of fibrous refractory material around the water cooled member in abutting relationship;

wrapping a tape of fibrous refractory composition around the mat to cover the mat;

applying a layer of non-penetrating refractory mortar on the outside of the tape; and allowing the mortar to harden and form a rigid outer shell.

8. A method of insulating a water cooled member of a skid rail system in a reheating furnace comprisng the steps of;

wrapping a permeable resilient mat of fibrous refractory material around the water cooled member in abutting relationship;

wrapping a tape of fibrous refractory composition around the mat to cover the mat; and helically winding a strip of heat resistant material around the outside of the mat prior to wrapping the tape around the mat.

9. A method of insulating a water cooled member of a skid rail system in a reheating furnace comprising the steps of:

wrapping a permeable resilient mat of fibrous refractory material around the water cooled member in abutting relationship;

wrapping a tape of fibrous refractory composition around the mat to cover the mat; and tying a plurality of strips of heat resistant material around the outside of the tape to form a plurality of spaced-apart loops thereon.

* * * * *